US006398353B1

(12) United States Patent
Tsuchii

(10) Patent No.: US 6,398,353 B1
(45) Date of Patent: Jun. 4, 2002

(54) INK TANK, AND LIQUID DISCHARGE RECORDING APPARATUS PROVIDED WITH SUCH INK TANK

(75) Inventor: Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/662,755

(22) Filed: Sep. 15, 2000

(30) Foreign Application Priority Data

Sep. 21, 1999 (JP) ..... 11-267256

(51) Int. Cl.[7] ..... B41J 2/175
(52) U.S. Cl. ..... 347/86
(58) Field of Search ..... 347/85, 86, 87, 347/93; 222/187, 56

(56) References Cited

U.S. PATENT DOCUMENTS 5,010,354 A * 4/1991 Cowger et al. ..... 347/87
5,509,140 A * 4/1996 Koitabashi et al. ..... 347/86
6,010,212 A * 1/2000 Yamashita et al. ..... 347/86
6,145,972 A 11/2000 Udagawa et al. ..... 347/86
6,176,572 B1 * 1/2001 Kato et al. ..... 347/87
6,293,665 B1 * 9/2001 Pew et al. ..... 347/87

FOREIGN PATENT DOCUMENTS

EP 803 364 * 10/1997

* cited by examiner

*Primary Examiner*—Michael P. Nghiem
(74) *Attorney, Agent, or Firm*—Fitzpatrick, Cella, Harper & Scinto

(57) ABSTRACT

An ink tank has a first containing chamber for containing a negative pressure generating member for retaining liquid and being provided with a atmospheric communication hole to make the negative pressure generating member to be communicative with the air outside; and a second containing chamber communicated with the first containing chamber for retaining liquid directly. For this ink tank, a liquid supply port for supplying liquid to the outside is provided for the first containing chamber, and for the second containing chamber as well. With the structure thus arranged, it becomes possible not only to continue stable consumption of ink in the second containing chamber, but even after ink in the second containing chamber is no longer available, ink in the first containing chamber can be used up to the last. Hence, a highly reliable and stable supply of ink is possible even when the number of nozzles or the driving frequency is increased for printing at higher speed.

11 Claims, 13 Drawing Sheets

INK TANK, AND LIQUID DISCHARGE RECORDING APPARATUS PROVIDED WITH SUCH INK TANK

BACKGROUND OF THE INVENTION

1. Field of the Invention

The present invention relates to an ink tank used for a liquid discharge recording apparatus for obtaining recorded images by discharging ink to the recording surface of a recording medium. The invention also relates to a liquid discharge recording apparatus provided with such ink tank. More particularly, the invention relates to an ink tank for ink jet use in the ink jet recording field, and to a printing apparatus provided with such ink tank as well.

2. Related Background Art

Conventionally, in the field of an ink jet recording apparatus, there has been proposed for an ink discharge head an ink tank that exerts negative pressure therein. As one of the easiest methods for generating negative pressure, there is a method to utilize the capillary force of a porous member. The ink tank that uses a method of the kind comprises a porous member, such as sponge, preferably compressed to be housed entirely inside an ink tank for the purpose of retaining ink; and an atmospheric communication port capable of inducing the air into the ink containing portion in order to smooth the ink supply during printing operation.

Here, however, the lower efficiency of ink storage per unit volume may be encountered as a problem when the porous material is used as an ink retaining member.

As the structures of ink tank that may be able to solve a problem of the kind, those shown in FIG. 12 and FIG. 13 are known.

FIG. 12 is a cross-sectional view which shows the structure of a first conventional example. As shown in FIG. 12, the first conventional example is divided into a first containing chamber 51 and a second containing chamber 50. Between the first containing chamber 51 and the second containing chamber 50, an opening portion 63 is arranged. With this opening portion 63, the first containing chamber 51 and second containing chamber 50 are communicated.

For the first containing chamber 51, a porous member formed by urethane sponge or the like is housed as the negative pressure generating member 56. The negative generating member 56 is kept in a state where ink has been absorbed, and the ink-filling portion 58 on the lower part of the negative generating member 56 is filled in with ink. In the negative pressure generating member 56, there is formed ink passage (hereinafter referred to as ink path) through which ink is supplied to the recording head 61. Also, for the second containing chamber 50, ink 53 is retained.

On the lower part of the negative generating member 56, a compressed contact member 59, which is formed by fibers solidified by heat or the like, is inserted, and the ink supply tube 62 through which ink is supplied to a recording head 61 is pressurized to be in contact with the compressed contact member 59 by way of a filer 60.

On the upper part of the first containing chamber 51, the atmospheric hole 55 is arranged through which the air outside 55A flows into the second containing chamber 50. Also, on the side wall that separates the first containing chamber 51 and second containing chamber 50, an atmospheric induction groove 62 is arranged to enable the air outside 55A entering from the atmospheric communication hole 55 to flow into the second containing chamber 50 as a bubble 54.

Now, hereunder, with reference to FIG. 12, the operation of the conventional example will be described.

When a printing apparatus begins its printing operation, the ink which has been absorbed into the negative pressure generating member 56 is consumed at first. Thus, the ink boundary face 57 of the first containing chamber 51 is lowered. As ink consumption advances so that the height of the ink boundary face 57 of the first containing chamber 51 is made from a level at A to a level at B in FIG. 12 to reach the upper edge of the atmospheric induction groove 62, the air outside 55A which has entered by way of the atmospheric communication hole 55 is induced into the second containing chamber 50 as a bubble 54 through the negative pressure generating member 56 and the atmospheric induction groove 62. When a bubble 54 enter the second containing chamber 50, the amount of air in the second containing chamber 50 becomes greater to press the ink boundary face 52 of the second containing chamber 50 downward.

Thus, the portion of ink which has been pressed downward is allowed to flow into the first containing chamber 51 through the opening portion 63. The ink 53 that has flown into the first containing chamber 51 is once absorbed into the negative pressure generating member 56. Then, through the ink path thereof (not shown) ink is supplied to the recording head 61 by way of the compressed contact member 59, the filter 60, and the ink supply tube 62, hence ink 53 in the second containing chamber 50 being consumed. After that, ink 53 in the second containing chamber 2 is continuously consumed until ink 53 in the second containing chamber 50 is completely used. After ink 53 in the second containing chamber 50 is no longer available, ink remaining in the negative pressure generating member 56 is consumed. When this ink is completely used, the ink tank becomes empty.

Now, FIG. 13 is a cross-sectional view which shows a second conventional example.

The structure of this conventional example is almost the same as that of the first conventional example shown in FIG. 12. However, the connecting unit (a rubber plug 70) of a recording head 73 is arranged on the lower part of the second containing chamber 50 which is not communicated with the air outside. This is difference between them. The recording head 73 and the second containing chamber 50 are coupled by the joint needle 71 of the recording head 73 which is pierced into the rubber plug 70 arranged on the bottom face of the second containing chamber 50.

Hereunder, with the reference to FIG. 13, the operation of this conventional example will be described.

When a printing apparatus begins its printing operation, the ink which has been absorbed into the negative pressure generating member 56 is consumed at first as in the first conventional example, and the height of the ink boundary face of the first containing chamber 51 is lowered. As ink consumption advances so that the height of the ink boundary face 57 of the first containing chamber 51 is made from a level at A to a level at B in FIG. 13 to reach the upper edge of the atmospheric induction groove 62, the air outside 55A is induced into the second containing chamber 50 as a bubble 54 through the atmospheric induction groove 62. When a bubble 54 enter the second containing chamber 50, the amount of air in the second containing chamber 50 becomes greater to press the ink boundary face 52 of the second containing chamber 50 downward.

Thus, the portion of ink 53 which has been pressed downward is allowed to flow directly into the recording head through the joint needle 71. Ink 53 in the second containing chamber 50 begins to be consumed. After that, ink 53 in the second containing chamber 50 is continuously consumed until ink 53 in the second containing chamber 50 is completely used. Even after ink 53 is no longer available in the second containing chamber 50, ink still remains in the negative pressure generating member 56. Here, however, the ink tank is considered to have been completely used up irrespective of such ink remainders in the ink tank.

Both ink tanks shown in FIG. 12 and FIG. 13 are excellent in the ink retaining efficiency.

Now, in accordance with the second conventional example shown in FIG. 13, the negative pressure in the second containing chamber 50 is lost and the pressure becomes positive after ink 53 in the second containing chamber 50 has been completely consumed. As a result, the remaining ink in the negative pressure generating member 56 is no longer used and remains as it is. Also, there is a problem that the ink which resides on the upper part of the filter 72 is subjected to leaking from the recording head 73.

Also, along with the increase of recording speed of an ink jet recording apparatus in recent years, there is a case where a large amount of ink is led out from an ink tank in a shorter period of time. However, In accordance with the first conventional example, the pressure loss in the negative pressure generating member 56 may sometimes increase along with the increase of ink flow rate. There is a fear, then, that it becomes difficult to continue the stable supply of ink.

Further, both for the first conventional example and second conventional example, the air is accumulated in the second containing chamber 50 when ink 53 in the second containing chamber 50 is consumed. Here, however, the air, the temperature, and the pressure are not necessarily constant all the time. These are always subjected to changes depending on seasons and localities. With environmental changes, such as temperature changes, pressure changes, the air in the second containing chamber 50 is caused to expand or contract. Then, ink in the second containing chamber 50 flows into the negative pressure generating member 56 in the first containing chamber 51 or returns therefrom each time such changes take place. With the repetition of such events, a problem may be encountered that the amount of ink retained in the negative pressure generating member 56 tends to be increased, and lastly, it overflows and leaks onto the recording head 73.

SUMMARY OF THE INVENTION

The present invention is designed in consideration of the problems that the conventional art has encountered as discussed above. It is an object of the invention to provide a highly reliable ink tank and a liquid discharge recording apparatus provided with such ink tank, which is capable of supplying ink stably even when the nozzle numbers are increased or driving frequency is increased for higher printing without ink leakage due to environmental changes, such as temperature changes, pressure changes.

With a view to solving the aforesaid problems, the ink tank of the present invention comprises a first containing chamber for containing a negative pressure generating member for retaining liquid, being provided with a atmospheric communication hole to make the negative pressure generating member to be communicative with the air outside; and a second containing chamber communicated with the first containing chamber, at the same time, retaining liquid directly. For this ink tank, a liquid supply port for supplying liquid to the outside is provided for the first containing chamber, and the second containing chamber.

For the present invention thus structure, the ink supply port for supplying ink to the outside is provided in a mode to communicate with both the first containing chamber and the second containing chamber. When ink (liquid) supply begins to the outside, such as to the recording head, ink is supplied in the same manner as the conventional art. The consumption of ink advances, and after the ink boundary face reaches the atmospheric induction groove, ink in the second containing chamber is consumed. When such ink is no longer available, ink remaining in the negative pressure generating member is consumed.

In this way, not only it becomes possible to continue stable consumption of ink in the second containing chamber, but there is no possibility that only ink in the negative pressure generating member is consumed, and ink in the second containing chamber is unused and left as it is as in the conventional art. Even after ink in the second containing chamber is no longer available, ink in the first containing chamber can be used up to the last.

Also, the ink supply port of the present invention is provided in a mode to be communicated both with the first and second containing chambers.

Also, the negative pressure generating member contained in the first containing chamber is arranged to supply ink to the outside through a filter. Also, a member for receiving negative pressure generating member is provided in a position becoming the upper part of the filter in order to receive the negative pressure generating member contained in the first containing chamber. In this manner, it becomes possible to avoid the deformation of filter, because the negative pressure generating member is locally in contact with the filter beginning with the opening portion of the member for receiving the negative pressure generating member.

Also, the ink supply port of the present invention is provided with a first ink supply port and a second ink supply port for the first containing chamber and second containing chamber, respectively. With this arrangement, it becomes possible to separate the ink tank from the recording head unit easily.

Also, for the second ink supply port of the present invention, a rubber plug is provided to enable a joint needle to pierce it for transferring ink, and the first ink supply port is provided with an opening face larger than the diameter of the joint needle.

Ink supply from the second containing chamber becomes better than ink supply from the first containing chamber where the negative pressure generating member is arranged, but if the opening area of the first ink supply port is made larger than the diameter of the joint needle that executes the ink supply from the second containing chamber as described above, it becomes possible to substantially equalize the ink supply from each of the containing chambers to the outside, such as to the recording head. As a result, ink can be supplied to the outside equally from each of the containing chambers.

Also, the printing apparatus of the present invention has an ink tank for use of ink jet printing installed therefor.

Further, the second containing chamber of the present invention comprises air escapement means for exhausting the air accumulated in the second containing chamber, and liquid supply means for supplying liquid to the second containing chamber.

Also, the air escapement means of the present invention is an exhaust tube communicated with an exhaust pump for exhausting the air accumulated in the second containing chamber, as well as with the second containing chamber.

Also, the air escapement means of the present invention is arranged on the upper part of the second containing chamber, and provided with first closing means for cutting off communication with the exhaust tube at any time other than when exhausting the air accumulated in the second containing chamber.

A method for using the aforesaid air escapement means and ink supply means may be structured in consideration of the following:

When the air is accumulated in the second containing chamber, the operation of the exhaust pump begins to exhaust the air in the second containing chamber. Then, ink is supplied from the ink supply tube to the second containing chamber. After that, when the air in the second containing chamber has been exhausted, the operation of the exhaust pump and the ink supply are suspended.

With these means used in this way, it becomes possible to suppress ink shift from the second containing chamber to the first containing chamber due to the expansion or contraction of the air accumulated in the second containing chamber, which may be caused by the environmental changes, such as temperature changes and pressure changes. Thus, ink leakage can be prevented. Also, when ink in the second containing chamber is no longer available, ink is supplied from the ink supply tube to the second containing chamber. As a result, there is no need for frequent replacement of ink tanks. Moreover, as the exhaust tube and ink supply tube are made separable from the second containing chamber, the structure of the apparatus can be made simpler to make the apparatus smaller at lower costs of manufacture.

Also, for the present invention, the exhaust tube is structured to be separable from the second containing chamber, and provided with second closing means for enhancing airtightness when the exhaust tube is communicated with the second containing chamber.

Also, for the present invention, the ink supply means comprises an ink supply tube for supplying ink to the second containing chamber, and a switching cock provided for the ink supply tube to supply or cut off ink to flow in the ink supply tube.

Also, for the present invention, the ink supply tube is made separable from the second containing chamber, and the ink supply tube is provided with an ink injection needle for connection with the second containing chamber, and the second containing chamber is provided with a rubber plug having a hole for the ink injection needle to be inserted.

DETAILED DESCRIPTION OF THE PREFERRED EMBODIMENTS

Hereinafter, with reference to the accompanying drawings the embodiments will be described in accordance with the present invention.

(First Embodiment)

Figure 1:
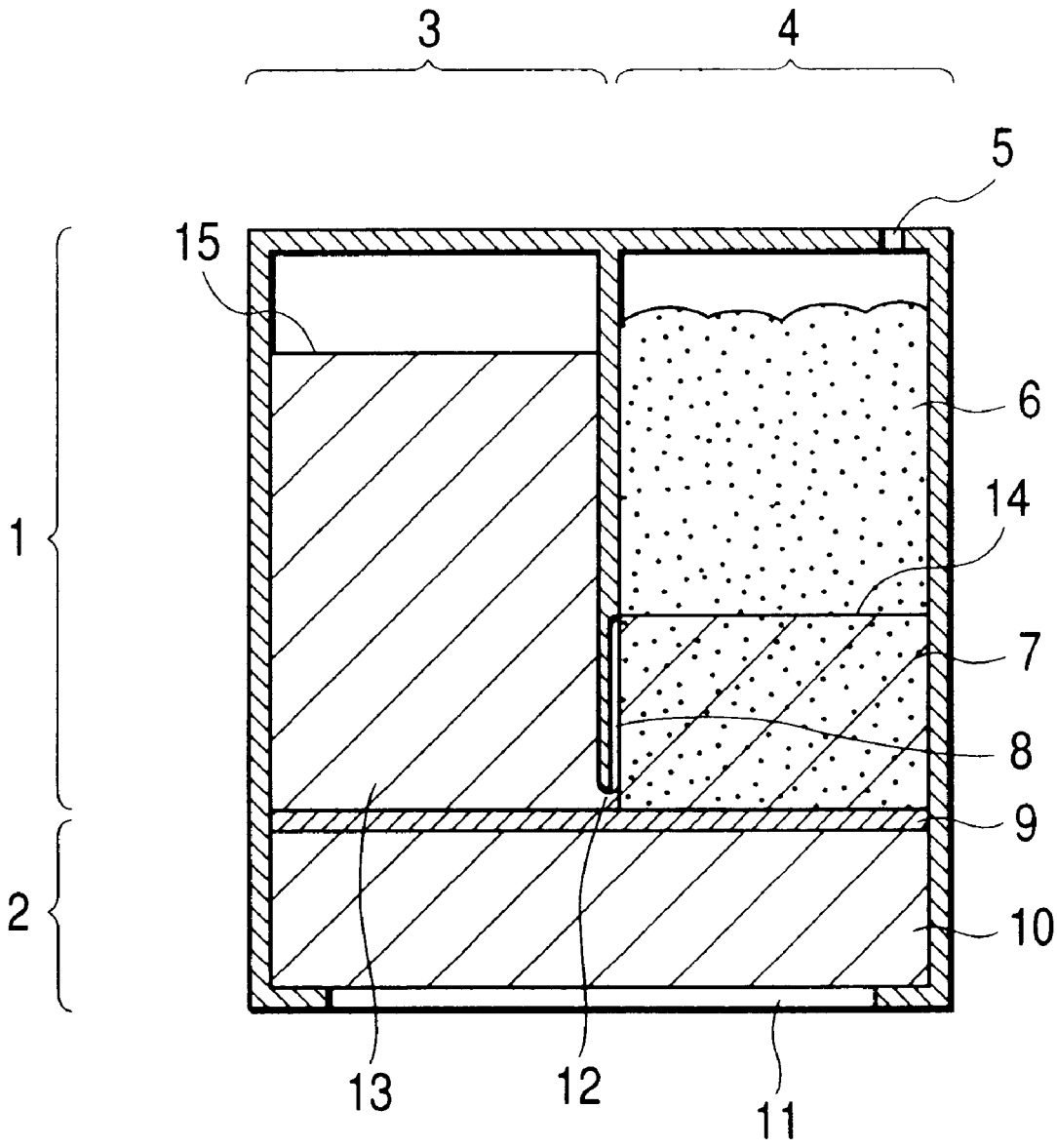
FIG. 1 is a cross-sectional view which shows the structure of a first embodiment in accordance with the present invention.

FIG. 1 is a cross-sectional view which shows a first embodiment in accordance with the present invention.

For the present embodiment, the ink supply port, through which ink is supplied to the recording head unit 2, is provided characteristically to be communicated with a first containing chamber 4 and a second containing chamber 3 as shown in FIG. 1.

In this structure, the ink tank portion 1 comprises the first containing chamber 4 and the second containing chamber 3, and then, coupled with the recording head unit 2 through a filter 9. The filter 9 which becomes a first ink supply port and a second ink supply port, through which ink is supplied, is provided for the recording head unit 2 in a mode of being communicated with both the first containing chamber 4 and the second containing chamber 3. On the upper part of the first containing chamber 4, an atmospheric communication hole 5 is arranged, and as a negative pressure generating member 6, porous material, such as sponge, is contained therein. In this negative pressure generating member 6, ink is retained. Also, ink 13 is retained in the second containing chamber 3.

Between the first containing chamber 4 and the second containing chamber 3, the opening portion 12 is arranged. Then, through this opening portion 12, the second containing chamber 3 is communicated with the first containing chamber 4. The lower part of the negative pressure generating member 6 of the first containing chamber 4 is directly in contact with the filter 9, and the bottom face of the second containing chamber 3 becomes the filter 9 as it is. The structure is arranged so that ink 13 in the ink tank unit 1 is supplied to the recording head unit 2 through this filter 9. The recording head unit 2 comprises the filter 9, the common liquid chamber 10, and the head chip 11. The common liquid chamber 10 is filled with ink, and ink is discharged from the head chip 11 to a recording medium to obtain recorded images.

Now, the description will be made of a method for discharging ink droplets from the head chip 11.

Figure 2A:
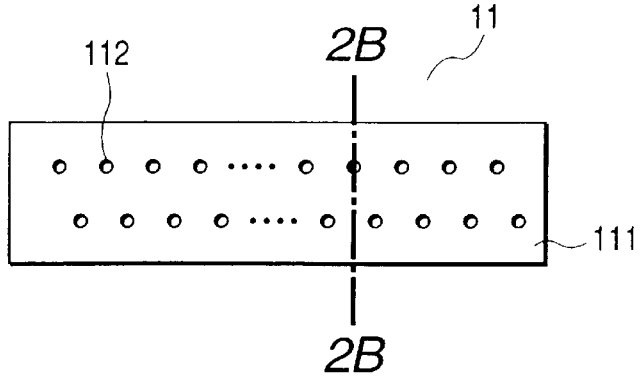
FIG. 2A is a view which shows a head chip, observed from the surface on the discharge port side.

FIG. 2A is a view which shows the head chip 11, observed from the surface on the discharge port side (hereinafter referred to as the face). As shown in FIG. 2A, on the surface of the face 111, a plurality of discharge ports 112 are arranged, which are provided to form two lines positioned differently but in parallel.

Figure 2B:
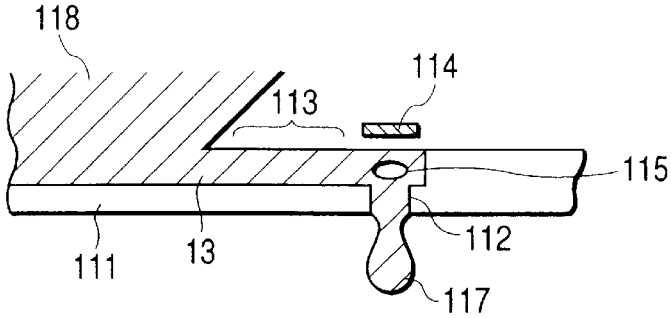
FIG. 2B is a cross-sectional view taken along one-dot chain line 2B—2B in FIG. 2A, which shows in enlargement the section from the common liquid chamber to the discharge port, in particular.

FIG. 2B is a cross-sectional view taken along one-dot chain line 2B—2B in FIG. 2A, which shows, in enlargement, the portion from the common liquid chamber 10 to the discharge port 112 in particular.

Ink 13 supplied from the ink supply opening portion 118 is discharged from the discharge port 112 through the flow path 113. Between these members, ink 13 is filled. There is arranged a heater 114 above each of the discharge ports 112, respectively, which is formed by the thin film formation process. When electric power is supplied from driving circuit (not shown), the heater 114 is heated, and with heat generated by the heater 114, bubble 115 is created in ink 13. Then, by the pressure thus exerted, ink droplet 117 is discharged from the discharge port 112.

Figure 2C:
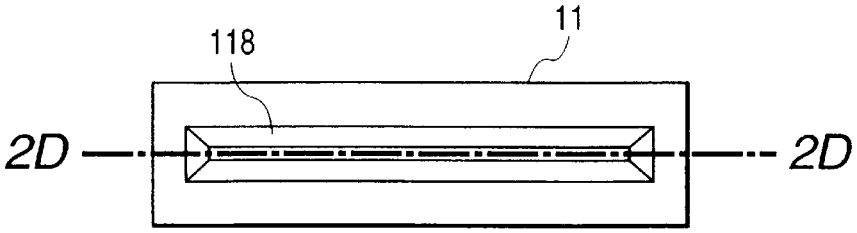
FIG. 2C is view which shows the heat chip, observed from the reverse side of the common liquid chamber.

FIG. 2C is a view which shows the head chip 11, observed from the reverse side on the common liquid chamber 10, and the ink supply opening portion 118, which is formed by use of anisotropic etching or the like, is arranged on the central portion thereof. From the common liquid chamber 10, ink is supplied up to the discharge port 112 through the ink supply opening portion 118.

Figure 2D:
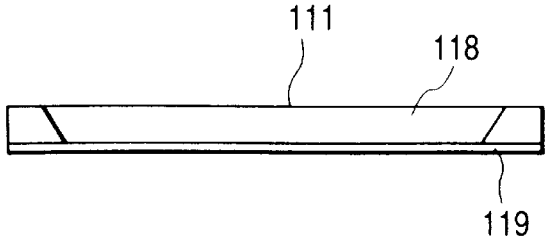
FIG. 2D is a cross-sectional view taken along one-dot chain line 2D—2D in FIG. 2C, which shows the sectional configuration of the ink supply opening portion.

FIG. 2D is a cross-sectional view taken along one-dot chain line 2D—2D in FIG. 2C, which shows the sectional configuration of the ink supply opening portion 118. A nozzle groove formation film 119 is formed for the head chip 11 on the face 111 side.

Now, hereunder, with reference to FIGS. 3A to 3C, the description will be made of the operation of the first embodiment in accordance with the present invention.

Figure 3A:
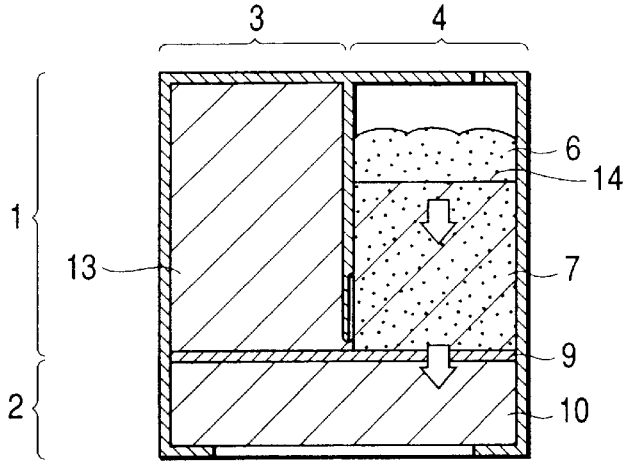
FIG. 3A is a view which shows the state of ink in the negative pressure generating member beginning to be consumed in the first containing chamber.

FIG. 3A is a view which shows the state of ink in the negative pressure generating member 6 beginning to be consumed in the first containing chamber 4; FIG. 3B is a view which shows the state where ink is consumed more, and the height of the ink boundary face reaches the upper edge of the atmospheric induction groove 8, and then, ink in the second containing chamber 3 begins to be consumed; and FIG. 3C is a view which shows the state where ink is consumed still more, and no ink exists in the second containing chamber 3, and then, ink that remains in the negative pressure generating member 6 begins to be consumed.

As shown in FIG. 3A, when the printing operation of a printing apparatus begins, ink absorbed in the negative pressure generating member 6 is at first consumed to begin lowering the ink boundary face 14 of the first containing chamber 4. Then, ink is supplied to the recording head unit 2 from the bottom face of the negative pressure generating member 6.

Figure 3B:
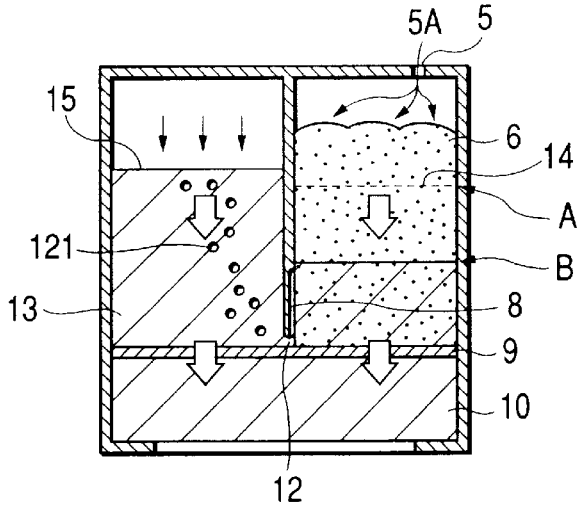
FIG. 3B is a view which shows the state where with ink being consumed more, the height of the ink boundary face reaches the upper edge of the atmospheric induction groove, and ink in the second containing chamber begins to be consumed.

With the progress of ink consumption, the height of the ink boundary face 14 of the first containing chamber 4 is lowered from A to B in FIG. 3B to reach the upper edge of the atmospheric induction groove 8. Then, as shown in FIG. 3B, the air outside 5A is allowed to flow into the second containing chamber 3 through the atmospheric induction groove 8, which becomes a bubble 121 that are inducted into the second containing chamber 3. When the air outside 5A enters the second containing chamber 3, the air in the second containing chamber 3 increases accordingly to press the ink boundary face 15 of the second containing chamber 3 downward. Thus, ink in the second containing chamber 3 begins to be consumed. Ink 13 in the second containing chamber 3 is directly supplied to the recording head unit 2 from the bottom face of the negative pressure generating member 6 through the filter 9. At this juncture, the pressure on the upper edge of the common liquid chamber 10 becomes substantially equal below both the second containing chamber 3 and the negative pressure generating member 6. Therefore, the pressure in the lower part of the negative pressure generating member 6 is not caused to be lowered greatly. As a result, the ink boundary face 15 of the first containing chamber 4 is maintained stably during the consumption of ink 13 in the second containing chamber 3.

Figure 3C:
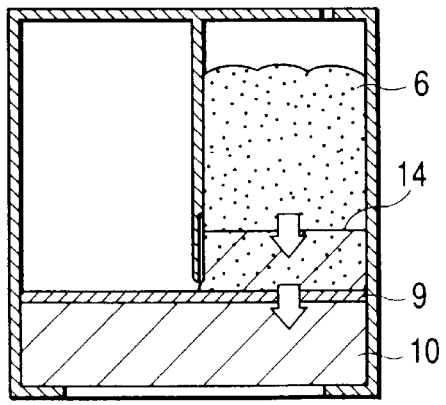
FIG. 3C is a view which shows the state where ink is consumed still more, and no ink exists in the second containing chamber, and then, ink that remains in the negative pressure generating member begins to be consumed.

When ink 13 in the second containing chamber 3 does not exist any longer with the further consumption of ink as shown in FIG. 3C, ink remaining in the negative pressure generating member 6 begins to be consumed then. Here, there is no possibility that ink in the common liquid chamber 10 is allowed to leak, because negative pressure in the negative pressure generating member 6 is maintained by the communicative condition between the negative pressure generating member 6 and the filter 9. Then, with ink being consumed still more, the ink, which is absorbed in the negative pressure generating member 6, is used up to the last, thus all ink in the ink tank having been used completely to make the ink tank empty.

As described above, in accordance with the present embodiment, it becomes possible to consume ink 13 in the second containing chamber 3 without lowering the pressure on the bottom face of the negative pressure generating member 6. As a result, even when nozzle numbers are increased in order to secure a higher printing speed or the driving frequency is increased to cope with a higher flow rate, the ink boundary face 14 can be maintained in the first containing chamber 4, hence making it possible to continuously consume ink in the second containing chamber 3 stably.

Also, after ink in the second containing chamber 3 is no longer available, negative pressure can be maintained stably to make it possible to use ink completely to the last without causing ink leakage.

(Second Embodiment)

Now, the description will be made of a second embodiment in accordance with the present invention.

Figure 4:
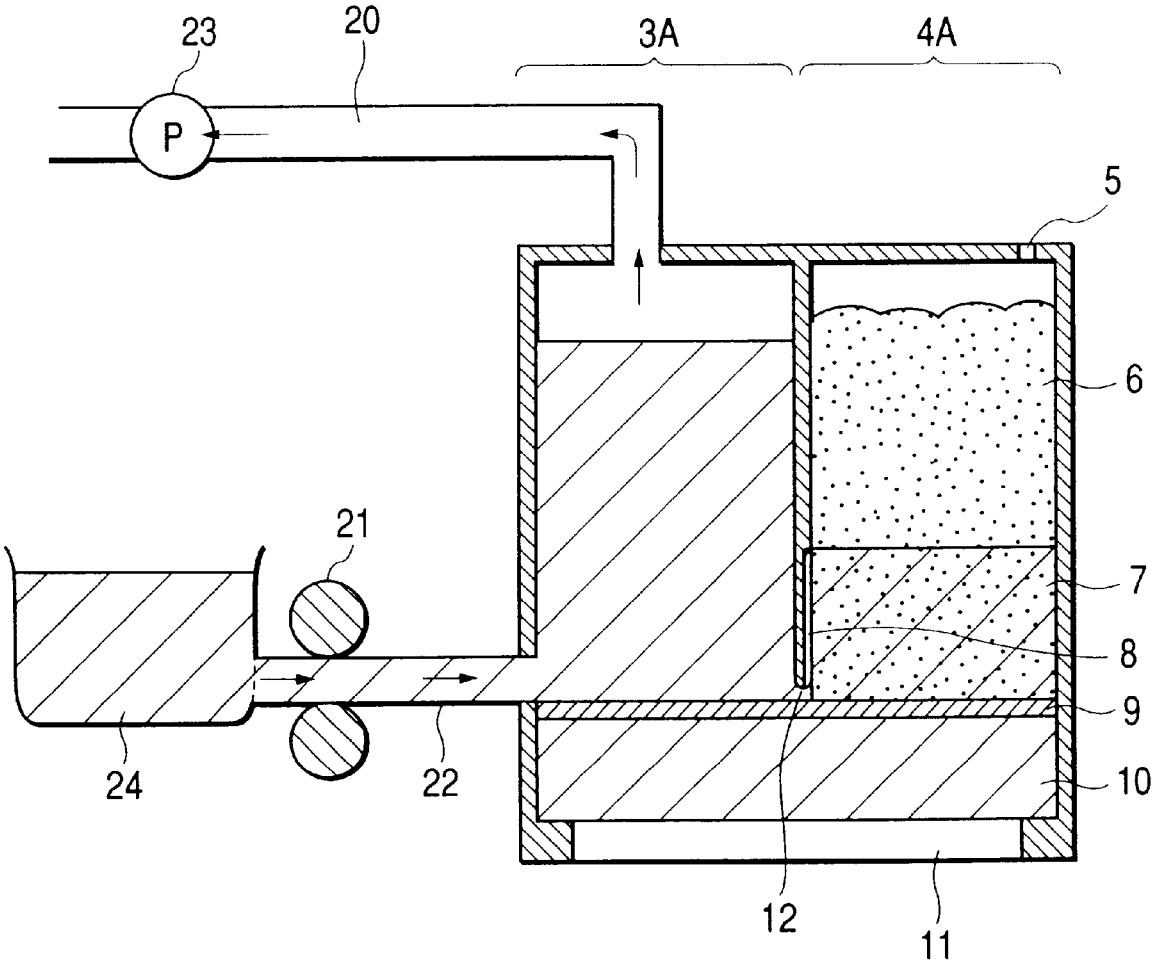
FIG. 4 is a cross-sectional view which shows the structure of a second embodiment in accordance with the present invention.

FIG. 4 is across-sectional view which shows the structure of the second embodiment of the present invention.

The present embodiment is characterized in that a second containing chamber 3A is provided with an air escapement tube 20 and an ink supply tube 22.

The air escapement tube 20 is arranged above the second containing chamber 3A, which is connected with an exhaust pump 23. In this arrangement, the air residing in the second containing chamber 3A is exhausted through the air escapement tube 20. Also, the ink supply tube 22 is connected with an ink tank 24 of large capacity the interior of which is negatively pressurized. The ink supply tube 22 is open or close by use of a switching cock 21. The switching cock 21 is closed during printing operation, and it opens when operating ink supply.

Any other structures than those described above are the same as the first embodiment described in FIG. 1. Therefore, the same reference marks are applied to the ones having the same structural elements.

Now, hereunder, with reference to FIG. 4, the operation of the present embodiment will be described.

When the printing operation of a printing apparatus begins, ink consumption in the second containing chamber 3A advances. Then, when the air is accumulated in the second containing chamber 3A, the operation of the exhaust pump 23 begins to start exhausting the air in the second containing chamber 3A. At this juncture, the switching cock 21 that has closed the ink supply tube 22 is open to supply ink from the large-capacity ink tank 24 to the second containing chamber 3A. When the air in the second containing chamber 3A is almost exhausted, the operation of the exhaust pump 23 is suspended. Also, the switching cock 21 of the ink supply tube 22 is closed.

In accordance with the present embodiment, it is possible to keep the amount of the air in the second containing chamber 3A at an extremely low level with the performance of the aforesaid operation at the termination of printing operation not only when the ink consumption becomes greater during printing operation, but even when printing is on standby. Consequently, there is almost no ink shift from the second containing chamber 3A to the first containing chamber 4A even if environmental changes, such as temperature changes, the atmospheric pressure changes, when printing is on standby, hence making it possible to prevent ink from leaking due to an ink shift of the kind.

Here, it may be possible to provide a switching cock for the air escapement tube 20. With such arrangement, the second containing chamber 3A becomes independent of the expansion or contraction of the air in the air escapement tube 20. Thus, stability is more increased against ink leakage.

Also, it may be possible to provide a valve or cover capable of being open or closed for the atmospheric communication hole 5 when the air is exhausted. In this manner, it becomes possible to intensify the suction power for the air if exhausted while the valve or the cover is closed. Then, the time required for exhaust or ink supply is made shorter.

As described above, in accordance with the present embodiment, it is possible to suppress the ink shift from the second containing chamber 3A to the first containing chamber 4A which may occur due to the expansion or contraction of the air accumulated in the second containing chamber 3A brought about by the environmental changes, such as temperature changes, the pressure changes. In this way, ink leakage can be prevented.

(Third Embodiment)

Further, a third embodiment will be described in accordance with the present invention.

Figure 5:
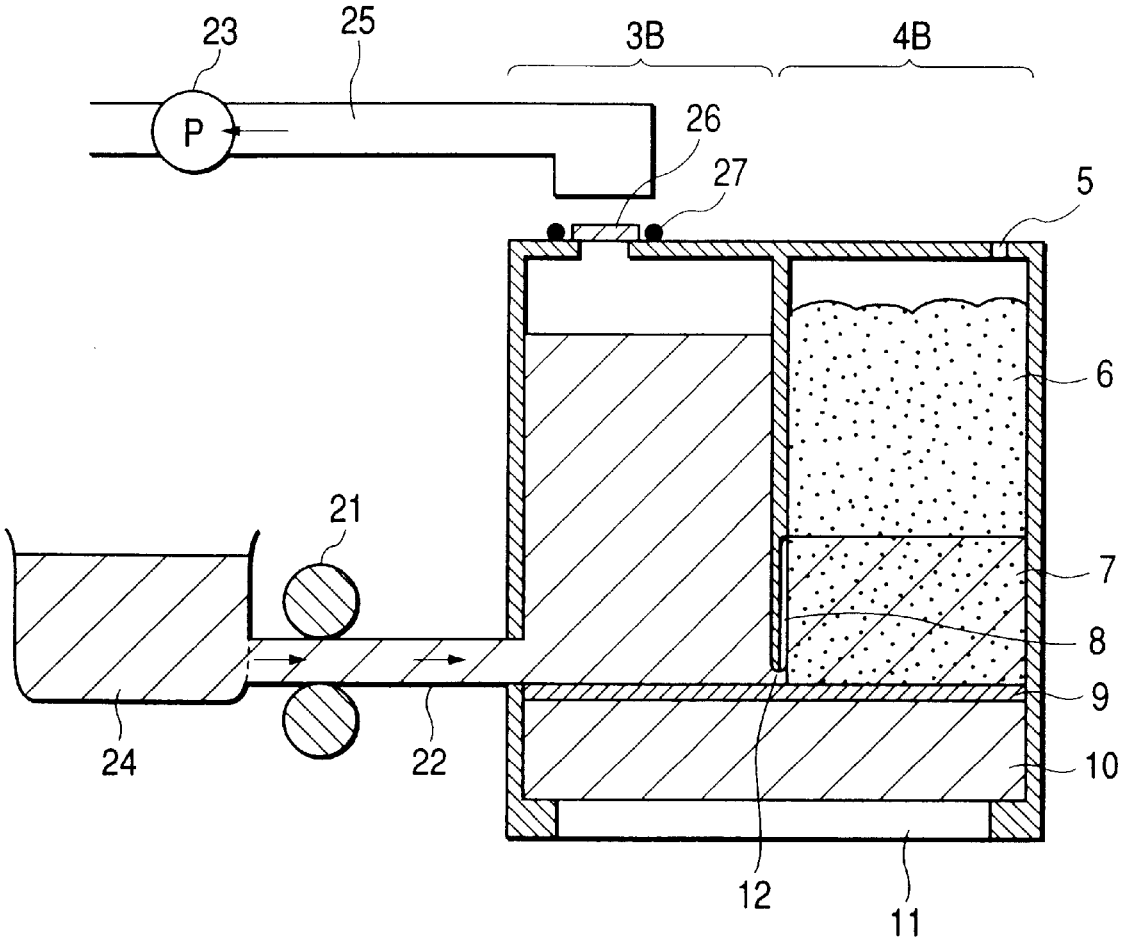
FIG. 5 is a cross-sectional view which shows the structure of a third embodiment in accordance with the present invention.

FIG. 5 is a cross-sectional view which shows the structure of the third embodiment of the present invention.

The present embodiment is characterized in that the exhaust tube 25 that performs the exhaust of a second containing chamber 3B is made independent of an ink tank.

In accordance with the present embodiment, there is provided above the second containing chamber 3B the check valve 26 that serves as first closing means to adjust exhaust to the exhaust tube 25, which is structured to be open to the outer side. The check valve 26 begins operating the exhaust pump 23 after the installation of the exhaust tube 25, and it opens when the pressure in the exhaust tube 25 is lowered by the pressure in the second containing chamber 3B. An O ring 27 serving as second closing means is arranged on the contact portion between the outer side of the ink tank and the exhaust tube 25 in order to enhance the airtightness when the exhaust tube 25 is installed to be communicative.

Any other structures other than these shown in FIG. 4 are the same as those of the second embodiment. Therefore, the same reference marks are applied to the same constituents.

Now, hereunder, with reference to FIG. 6, the operation will be described in accordance with the present embodiment.

Figure 6:
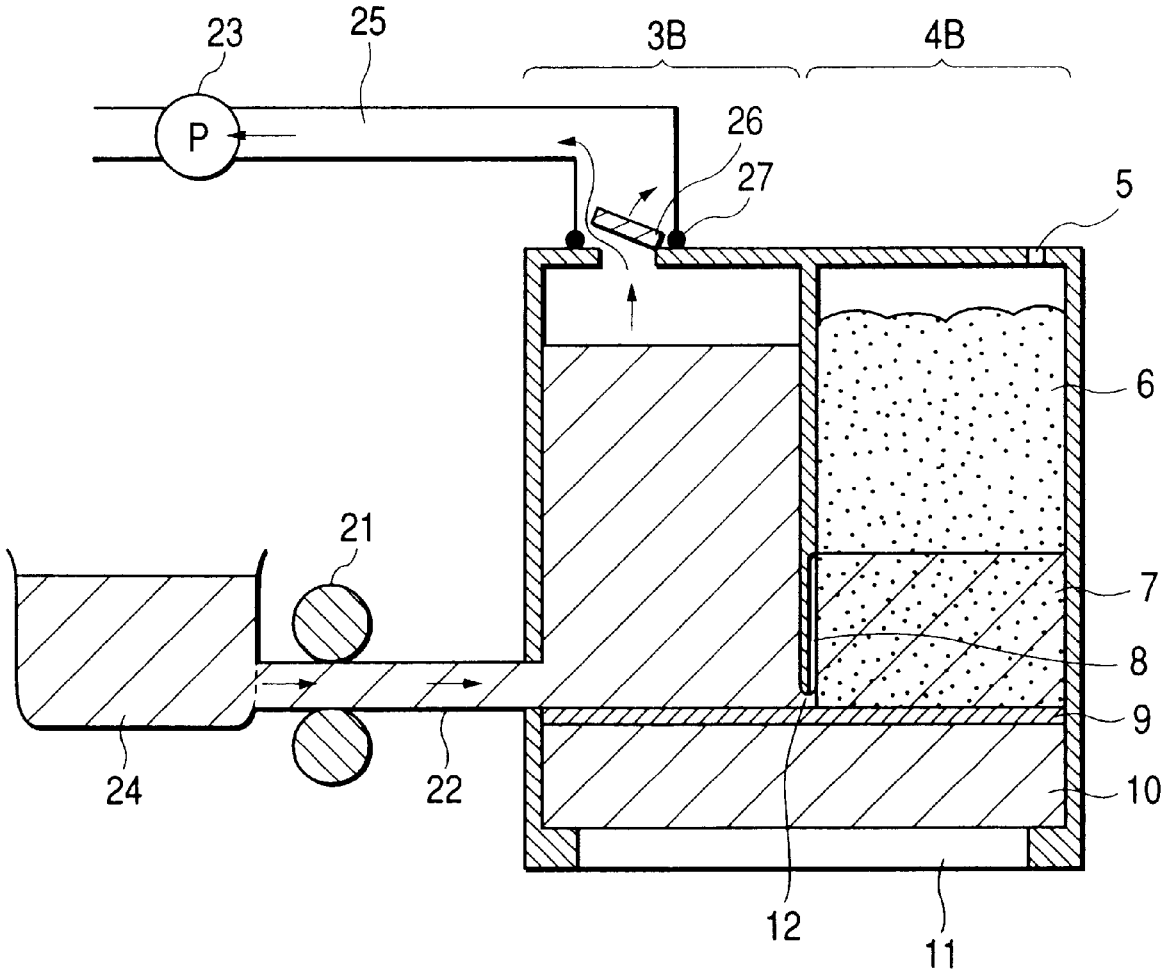
FIG. 6 is a view which shows the state where the air in the second containing chamber is exhausted to the outside through an exhaust tube.

FIG. 6 is a view which shows the state where the air in the second containing chamber 3B is being exhausted to the outside through the exhaust tube 25.

When the printing operation of a printing apparatus begins, the ink consumption in the second containing chamber 3B advances. Then, when the air is accumulated in the second containing chamber 3B, the exhaust tube 25 is installed on the outer side of the ink tank to be communicative through the O ring 27. The exhaust pump 23 begins to operate, and the check valve 26 is open to the outer side when the pressure in the exhaust tube 25 is made lower than the pressure in the second containing chamber 3B, thus beginning to exhaust the air in the second containing chamber 3B. At this juncture, the switching cock 21, which has closed the ink supply tube 22, is open to supply ink from the large-capacity ink tank 24 to the second containing chamber 3B. The exhaust pump 23 suspends its operation when most of the air in the second containing chamber 3B has been exhausted. The switching valve 21 of the ink supply tube 22 is also closed. After that, the exhaust tube 25 is separated to be released to the atmospheric pressure, and the check valve 26 is closed.

As described above, in accordance with the present embodiment, the exhaust tube 25 can be separated from the second containing chamber 3B. Therefore, it becomes possible to reduce the amount of tube that should be drawn around during printing operation to make the structure of the apparatus simpler to make the apparatus smaller at lower costs of manufacture.

(Fourth Embodiment)

In continuation, the description will be made of a fourth embodiment in accordance with the present invention.

Figure 7:
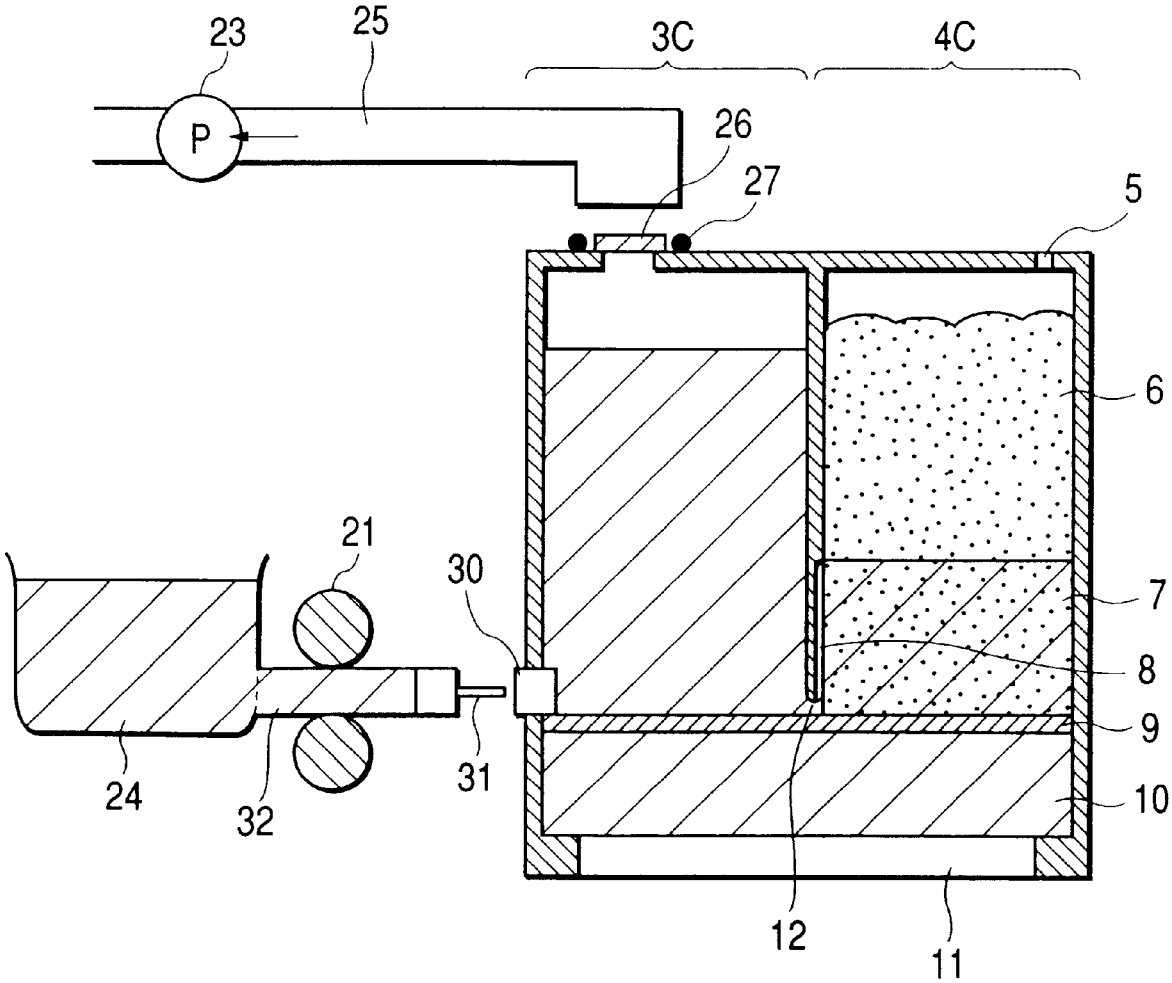
FIG. 7 is a cross-sectional view which shows the structure of a fourth embodiment in accordance with the present invention.

FIG. 7 is a cross-sectional view which shows the structure of a fourth embodiment in accordance with the present invention.

The present embodiment is characterized in that the ink supply tube 32 that supplies ink to a second containing chamber 3C is made independent from an ink tank.

The leading end of the ink supply tube 32 has an ink injection needle 31 fixed thereto, which is pierced into the rubber plug 30 arranged at the lower part of the second containing chamber 3C to join them together.

Any other structures than these are the same as the third embodiment shown in FIG. 5. The same reference marks are applied to the same constituents for indication.

Now, with reference to FIG. 8, the operation of the present embodiment will be described.

Figure 8:
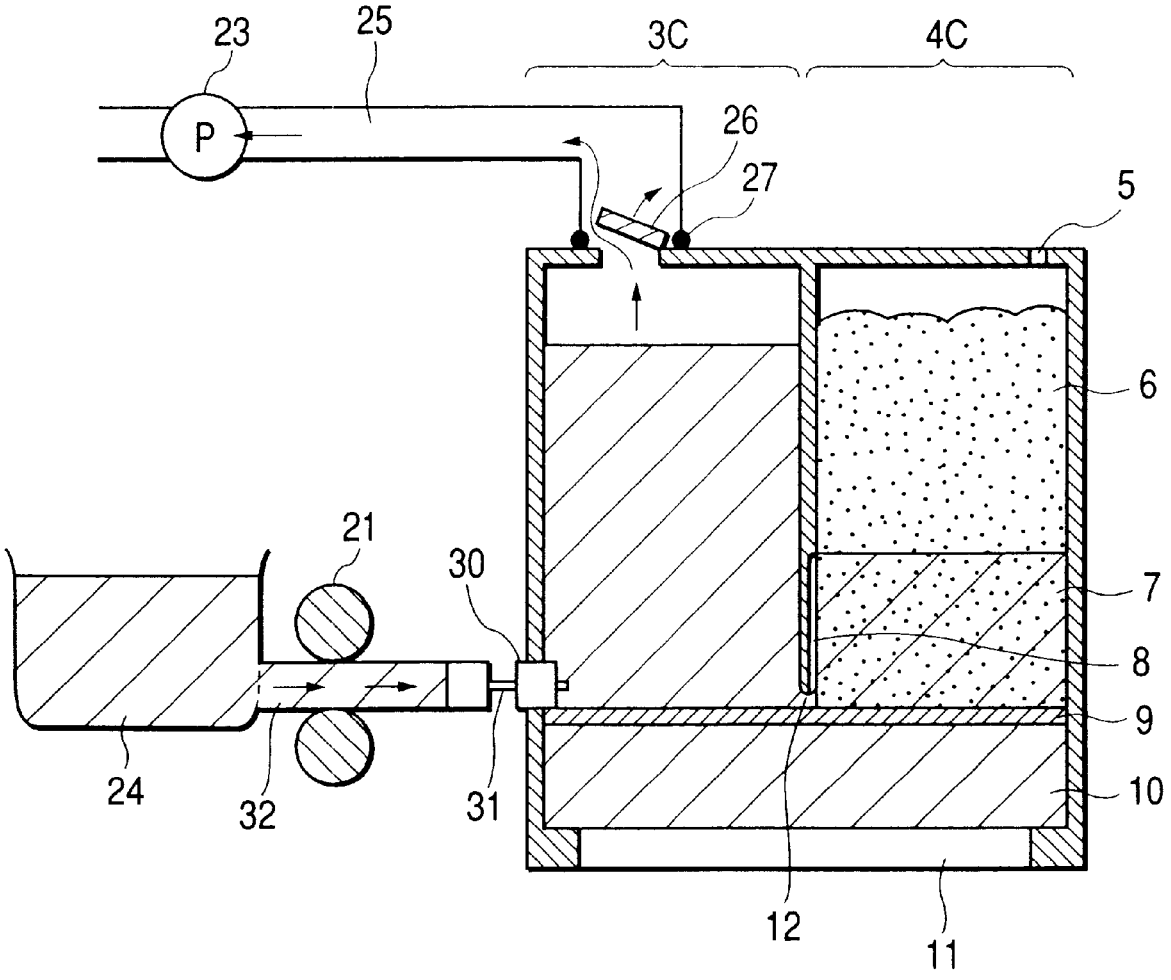
FIG. 8 is a view which shows the state where the air in the second containing chamber is exhausted to the outside through an exhaust tube.

FIG. 8 shows the state where the air in the second containing chamber 3C is being exhausted to the outside through the exhaust tube 25.

When the printing operation of a printing apparatus begins, the ink consumption in the second containing chamber 3C advances. Then, when the air is accumulated in the second containing chamber 3C, the exhaust tube 25 is installed on the outer side of the ink tank to be communicative through the O ring 27, and at the same time, the ink injection needle 31 of the ink supply tube 32 is pierced into the rubber plug 30 on the lower part of the second containing chamber 3C. Then, the exhaust pump 23 begins to operate, and the check valve 26 is open to the outer side when the pressure in the exhaust tube 25 is made lower than the pressure in the second containing chamber 3C, thus beginning to exhaust the air in the second containing chamber 3C. At this juncture, the switching cock 21, which has closed the ink supply tube 32, is open to supply ink from the large-capacity ink tank 24 to the second containing chamber 3C. The exhaust pump 23 suspends its operation when most of the air in the second containing chamber 3C has been exhausted. The switching valve 21 of the ink supply tube 32 is also closed.

After that, the exhaust tube 25 is separated to be released to the atmospheric pressure, and the check valve 26 is closed. At the same time that the exhaust tube 25 is separated, the ink injection needle 31 of the ink supply tube 32 is also drawn out, hence conditioning the ink tank to be independent.

As described above, in accordance with the present embodiment, the ink supply tube 32 is made separable from the second containing chamber 3C to make it possible to simplify the structure of the apparatus, as well as to make it smaller still at lower costs of manufacture.

(Fifth Embodiment)

In continuation, the description will be made of a fifth embodiment in accordance with the present invention.

Figure 9A:
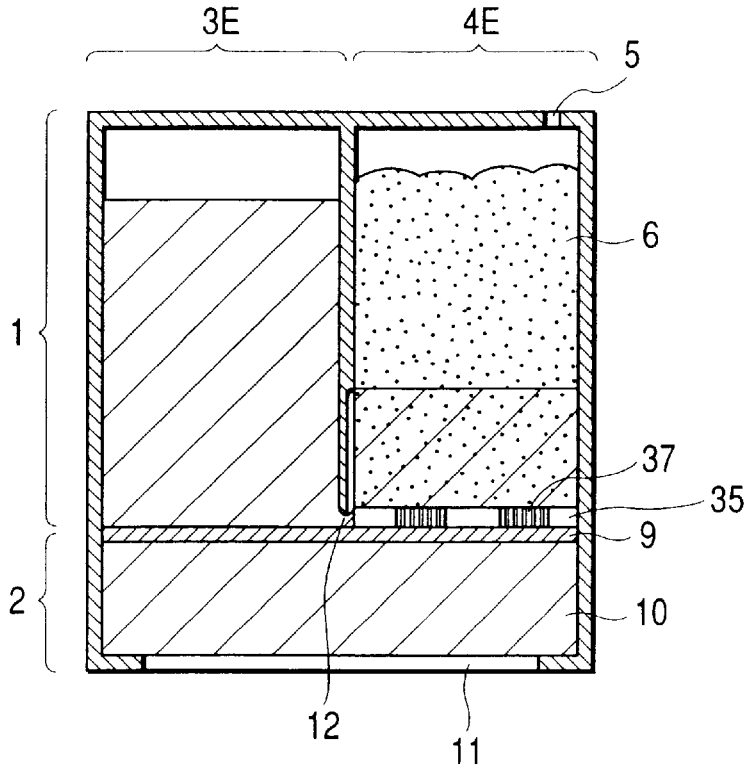
FIG. 9A is a cross-sectional view which shows the structure of a fifth embodiment in accordance with the present invention.

FIG. 9A is a cross-sectional view which shows the structure of the fifth embodiment of the present invention.

The present embodiment is characterized in that a member 35 for receiving a negative pressure generating member is arranged with an opening portion above the recording head unit 2, and that the negative pressure generating member 6 is locally in contact with a filter 9.

Any other structures than these are the same as the first embodiment shown in FIG. 1. The same reference marks are applied to the same constituents for indication.

Figure 9B:
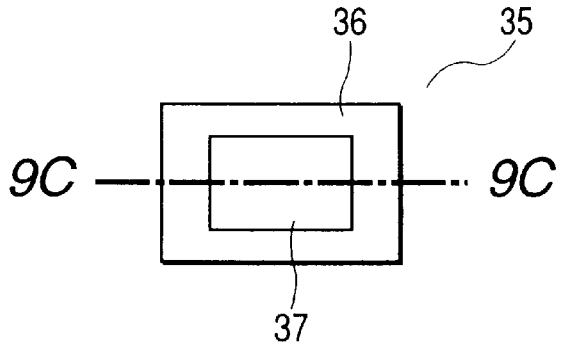
FIG. 9B is a plan view which shows the shape of a receiving member for the negative pressure generating member.
Figure 9C:
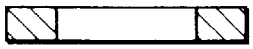
FIG. 9C is a cross-sectional view taken along one-dot chain line 9C—9C in FIG. 9B.

FIG. 9B is a plan view which shows the shape of the member 35 for receiving the negative pressure generating member. FIG. 9C is a cross-sectional view taken along one-dot chain line 9C—9C in FIG. 9B.

The member 35 for receiving the negative pressure generating member is provided with a framed opening portion 37 on the central portion thereof. This member is installed on the filter 9 as shown in FIG. 9A. Then, the negative pressure generating member 6 is received on it.

Here, it is necessary for the negative pressure generating member 6 to be compressed and housed in the first containing chamber 4E in order to provide such prerequisite as the drop resistance capability, the stabilized ink supply capability of the negative pressure generating member 6, among some others. In some cases, however, it becomes impossible for the filter 9 to keep an appropriate contacting condition due to the deformation thereof caused by the repellent force of the negative pressure generating member 6 which is in contact with the filter 9 in the compressed state.

In order to avoid such condition as this, the member 35 for receiving the negative pressure generating member is provided to be in contact with the filter 9 in accordance with the present embodiment so that the intensive repellent force of the negative pressure generating member 6 is received by the frame portion 36 of the member 35 for receiving the negative pressure generating member. Thus, the negative pressure generating member 6 is allowed to be in contact locally with the filter 9 beginning with the opening portion in a slightly relaxed condition.

The detailed description of the operation of the present embodiment will be omitted.

As described above, in accordance with the present embodiment, it becomes possible to avoid the deformation of the filter 9, because the negative pressure generating member 6 is in contact with the filter 9 locally in a slightly relaxed condition beginning with the opening portion 37 of the member 35 for receiving the negative pressure generating member.

(Sixth Embodiment)

Now, the description will be made of a sixth embodiment in accordance with the present invention.

Figure 10:
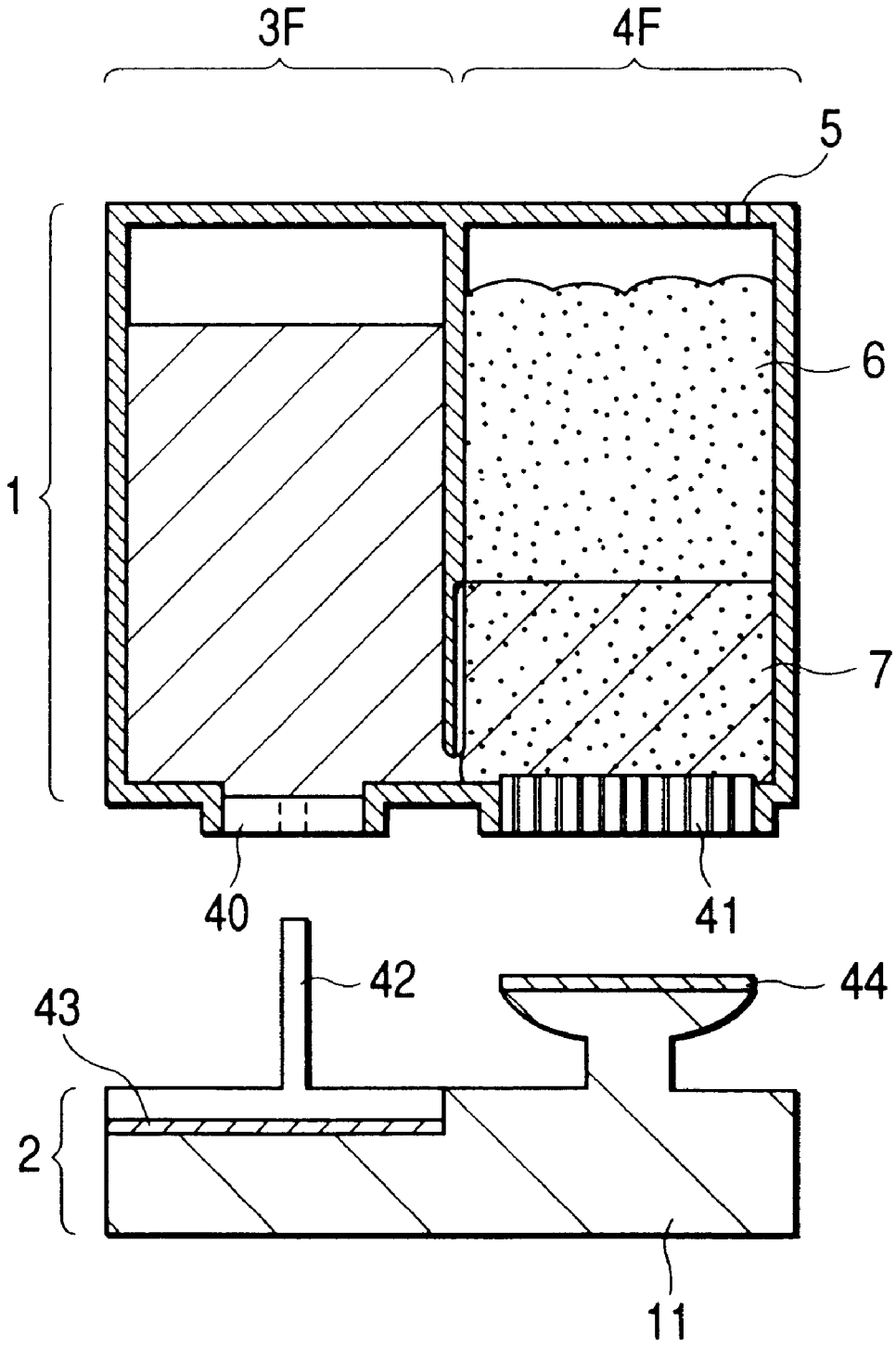
FIG. 10 is a cross-sectional view which shows the structure of a sixth embodiment in accordance with the present invention.
Figure 11:
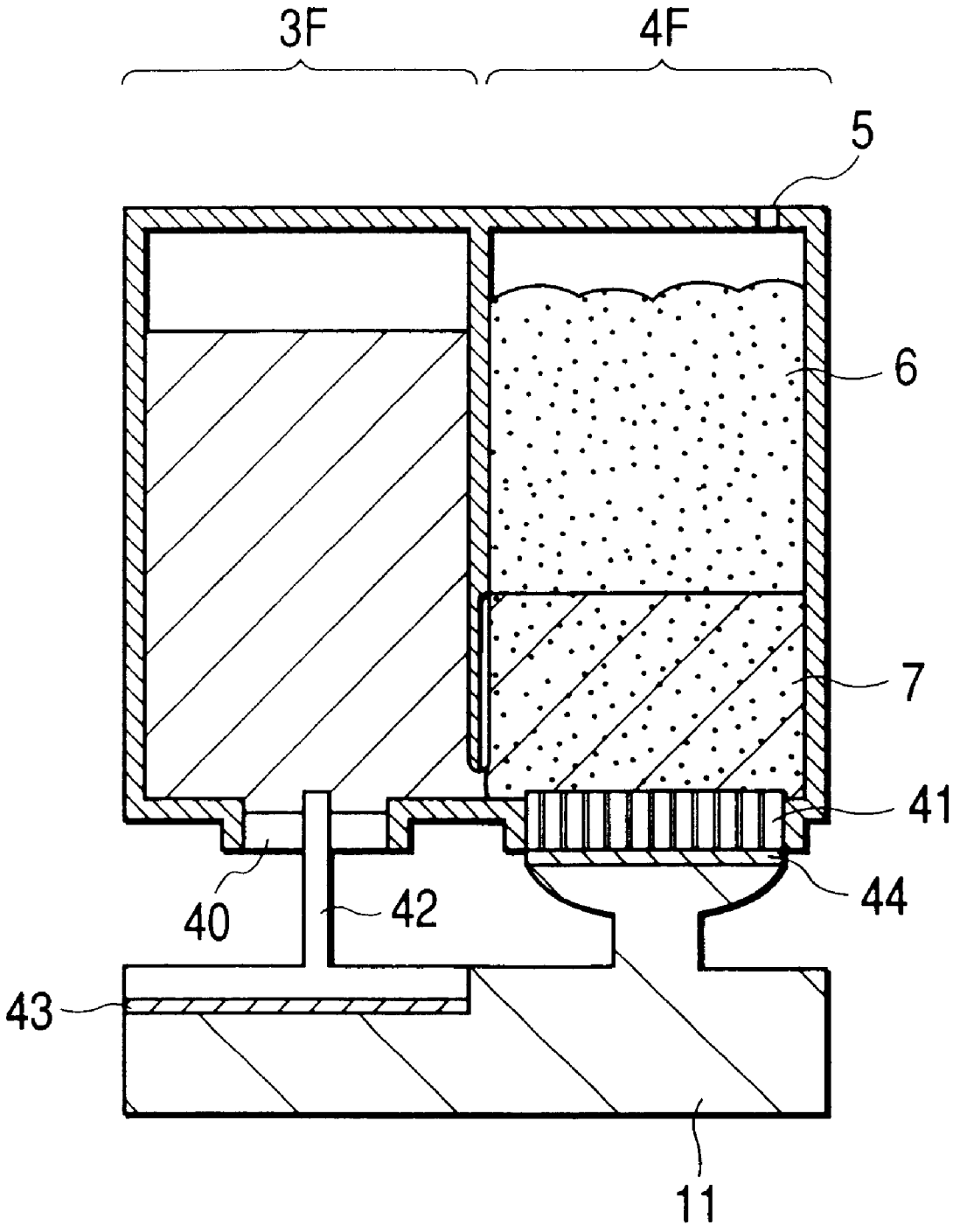
FIG. 11 is a view which shows the state where the joint needle of a recording head unit is pierced into the rubber plug so as to press the filter to be in contact with the compressed contact member.
Figure 12:
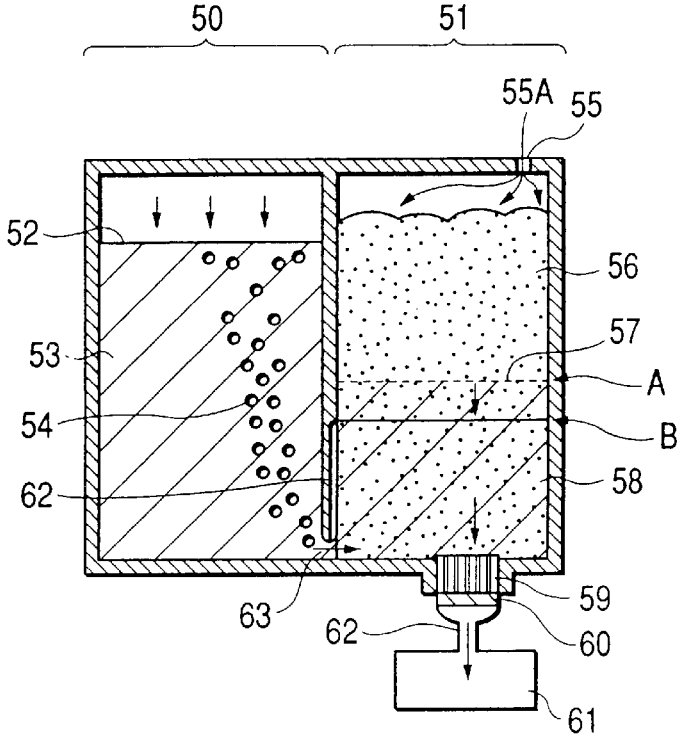
FIG. 12 (Prior Art)
FIG. 12 is a cross-sectional view which shows the structure of the first conventional example.
Figure 13:
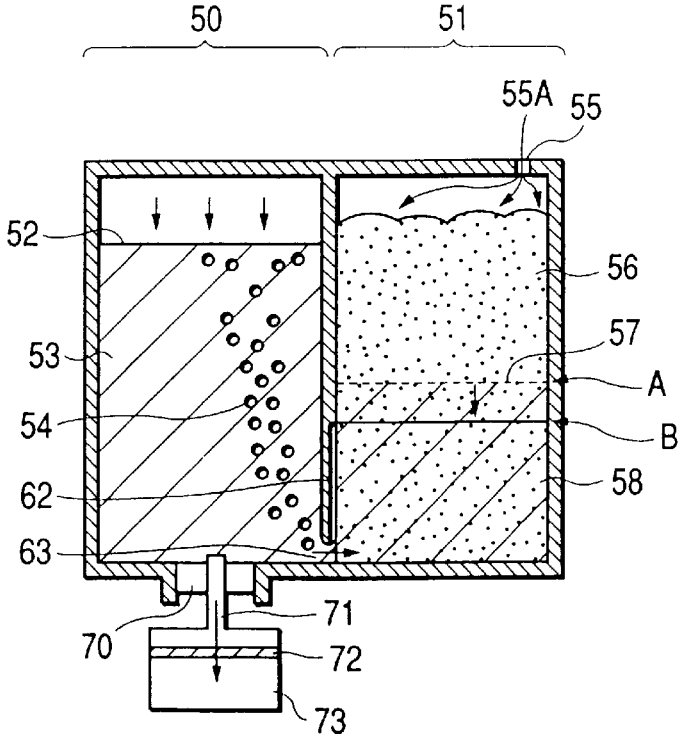
FIG. 13 (Prior Art)
FIG. 13 is a cross-sectional view which shows the structure of the second conventional example.

FIG. 10 and FIG. 11 are cross-sectional views which illustrate the structure of the sixth embodiment of the present invention. Particularly, FIG. 11 is a view which shows the state where the joint needle 42 of a recording head unit 2 us pierced into a rubber plug 40 and a filter 44 is in contact with a compressed contact member 41 under pressure.

The present embodiment is characterized in that the compressed contact member 41 is arranged on the bottom face of the first containing chamber 4F to be in contact with the filter 44 of the recording head unit 2 under pressure, and that the rubber plug 40 is provided for the bottom face of the second containing chamber 3F in order to connect with the joint needle 42 of the recording head unit 2.

The detailed operation of the present embodiment will be omitted.

As described above, in accordance with the present embodiment, the opening area of a first ink supply port is made larger than the diameter of the joint needle 42 to substantially equalize ink supply from the first containing chamber 3F and the second containing chamber 4F to the recording head unit 2. Also, it is made possible to separate the ink tank from the recording head unit 2.

(Other Embodiment)

Now, lastly, in conjunction with FIG. 14, the description will be made of the liquid discharge recording apparatus to which the present invention is applicable. Here, for the embodiments described in accordance with FIG. 4 to FIGS. 9A to 9C, the ink supply tube 22, and the disposal pump 23 are provided for each of them, although not shown in FIG. 14.

Figure 14:
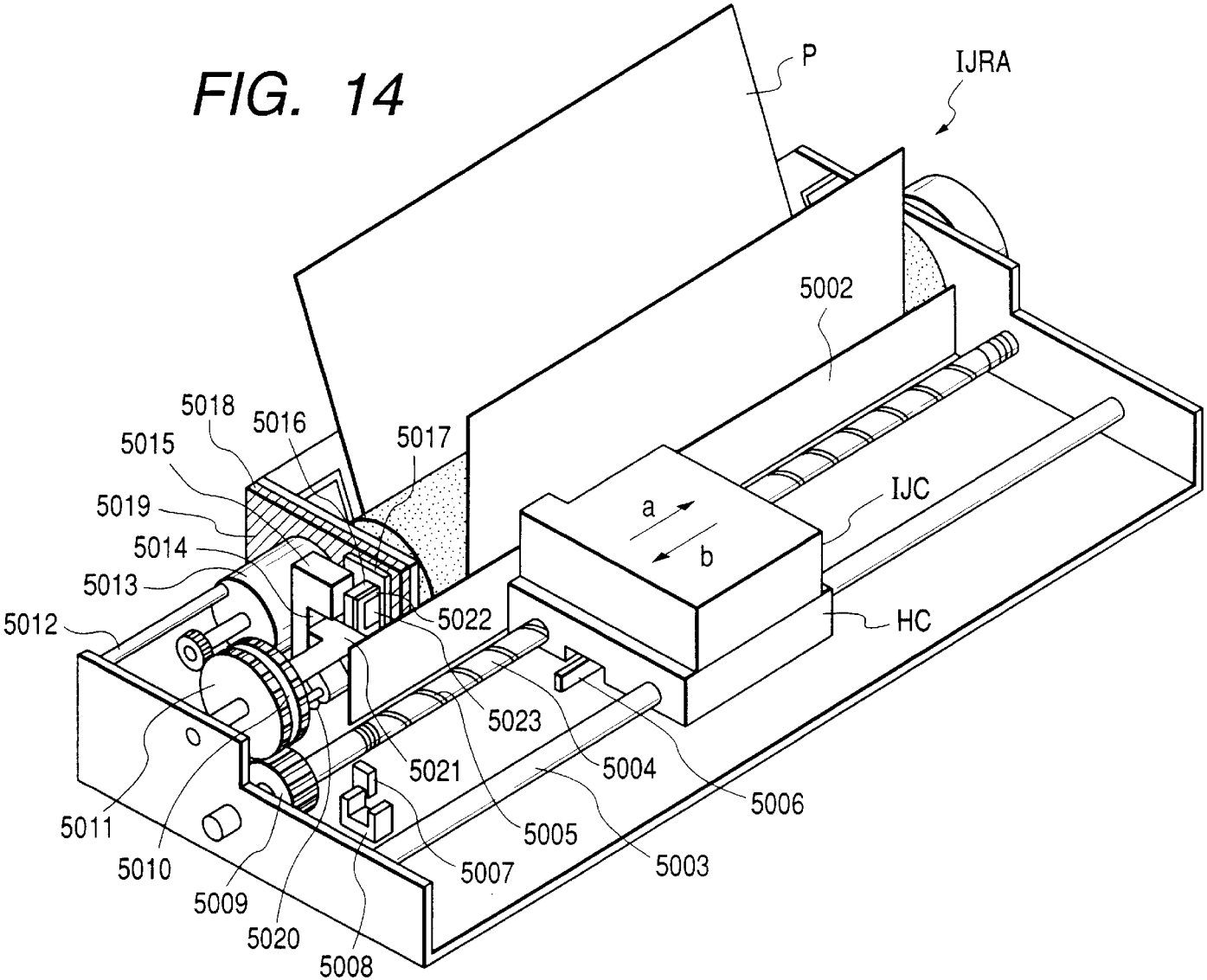
FIG. 14 is a view which schematically illustrates a liquid discharge recording apparatus in accordance with the present invention.

FIG. 14 is a view which schematically shows the ink jet recording apparatus IJRA that uses an ink jet cartridge of the present invention.

As shown in FIG. 14, the ink jet cartridge IJC, which is formed integrally with a recording head and an ink tank together, is mounted on a carriage HC, and with the carriage HC, it reciprocates in the directions indicated by arrows a and b in FIG. 14 for recording on a recording medium P. Here, a pin (not shown) is provided for the carriage HC to engage with the spiral groove 5005 of a lead screw 5004. Then, when a driving motor 5013 rotates (regularly or reversely), the rotation thereof is transmitted to the lead screw 5004 through driving power transmission gears 5011 and 5009. With the rotation of the lead screw 5004, the carriage reciprocates along the guide shaft 5003 in the directions indicated by the arrows a and b.

Also, a sheet pressure plate 5002 is arranged over the traveling direction of the carriage HC to press the recording medium P to a platen.

Also, as home position detecting means for the carriage HC, photocouplers 5007 and 5008 are arranged to confirm the presence of the lever 5006 which is provided for the carriage HC in this section, thus switching the rotational directions of the motor 5013, among some other operations.

Also, as recording head recovery means, there are provided a cap member 5022 for capping the front face of the recording head; a supporting member 5016 for supporting the cap member 5022; a suction member 5015 for sucking the interior of the cap member 5022; a cleaning blade 5017 supported by the main body supporting plate 5018 for cleaning the front face of the recording head; and a member 5019 supported by the main body supporting plate 5018 for moving the cleaning blade 5017 forward and backward. The suction recovery of the recording head is performed by them through the inner opening 5023 of the cap. Here, the cleaning blade is not necessarily limited to this mode. It is of course possible to adopt any one of known cleaning blades for the present embodiment.

Also, a lever 5012 is arranged for the sucking initiation for the suction recovery, which moves along with the movement of a cam 5020 engaging with the carriage HC. Then, the movement control is carried out by the driving power of a driving motor 5013, which is transmitted through a transmitting means, such clutch switching.

Here, the structure is arranged so that the capping, cleaning, and suction recovery are carried out for the respective processes as desired in the corresponding positions by the function of the lead screw 5005 when the carriage HC is positioned in the region on the home position side. However, any structure may be applicable to the present embodiment if only desired operations are made possible at known timing.

So far, each of the embodiments of the present invention has been described. However, it is to be understood that the present invention is not limited to each of the aforesaid embodiments. Obviously, each of the embodiments can be arbitrarily combined or appropriate modification is possible within the range of the technical thought of the present invention.

As apparent from the above description, it is possible for the present invention to demonstrate remarkable effects as given below.

(1) Ink in the second containing chamber can be consumed without lowering the pressure of the negative pressure generating member significantly. As a result, even if the nozzle numbers are increased or driving frequency is increased for higher printing, ink can be supplied stably. Moreover, even after ink in the second containing chamber has been used up, negative pressure can be maintained in a recording head, hence making it possible to prevent ink from leaking due to environmental changes, such as temperature changes, pressure changes.

(2) It is possible to suppress ink shift from the second containing chamber to the first containing chamber due to the expansion or contraction of the air accumulated in the second containing chamber due to environmental changes, such as temperature change, pressure changes. Thus, ink leakage can be prevented.

(3) The exhaust tube is made separable from the second containing chamber to make it possible to reduce the amount of tube that should be drawn around during printing. Thus, the structure of the apparatus can be made simpler. The apparatus can be made smaller at lower costs of manufacture accordingly.

(4) When ink in the second containing chamber is no longer available, ink is supplied from a large-capacity ink tank. As a result, there is no need for replacing ink tanks often.

(5) The ink supply tube is made separable from the second containing chamber to make it possible to simplify the apparatus, and make the apparatus smaller at lower costs of manufacture accordingly.

(6) The check valve and the O ring are arranged for the upper part of the second containing chamber to enhance the airtightness thereof still more.

(7) The filter is arranged to be in contact with the opening portion locally in a state where the negative pressure generating member is slightly relaxed. As a result, it becomes possible to avoid the deformation of the filter.

(8) The ink tank is made separable from the recording head unit.

What is claimed is:

1. An ink container comprising:

a first containing chamber for containing a negative pressure generating member for retaining liquid, said first containing chamber being provided with an atmospheric communication hole to make said negative pressure generating member communicative with air outside;

a second containing chamber communicated directly with said first containing chamber, for retaining liquid directly; and a third chamber for supplying liquid to outside of said ink container, said third chamber being provided with a liquid supply port to make said third chamber communicative directly with said first containing chamber and said second containing chamber.

2. An ink container according to claim 1, wherein said negative pressure generating member contained in said first containing chamber supplies ink to the third chamber through a filter.

3. An ink container according to claim 1, wherein said liquid supply port comprises a first ink supply port and a second ink supply port for said first containing chamber and second containing chamber, respectively.

4. An ink container according to claim 3, wherein said second ink supply port is provided with a rubber plug piercable by a joint needle for transferring ink, and said first ink supply port is provided with an opening face larger than the diameter of said joint needle.

5. A liquid discharge recording apparatus having a detachably mountable ink container including a liquid discharge recording head for discharging liquid, wherein said ink container comprises:

a first containing chamber for containing a negative pressure generating member for retaining liquid, said first containing chamber being provided with an atmospheric communication hole to make said negative pressure generating member communicative with air outside;

a second containing chamber communicated directly with said first containing chamber, for retaining liquid directly; and a third chamber for supplying liquid to outside of said ink container, said third chamber being provided with a liquid supply port to make said third chamber communicative directly with said first containing chamber and second containing chamber.

6. A liquid discharge recording apparatus according to claim 5, wherein said second containing chamber is provided with air escapement means for exhausting air accumulated in said second containing chamber, and liquid supply means for supplying liquid to said second containing chamber.

7. A liquid discharge recording apparatus according to claim 6, wherein said air escapement means is an exhaust tube communicated with an exhaust pump for exhausting the air accumulated in said second containing chamber.

8. A liquid discharge recording apparatus according to claim 7, wherein said air escapement means is arranged on an upper part of said second containing chamber, and provided with first closing means for cutting off communication with said exhaust tube at any time other than when exhausting the air accumulated in said second containing chamber.

9. A liquid discharge recording apparatus according to claim 7, wherein said exhaust tube is made separable from said second containing chamber, and provided with second closing means for enhancing airtightness when said exhaust tube is communicated with said second containing chamber.

10. A liquid discharge recording apparatus according to claim 6, wherein said liquid supply means comprises an ink supply tube for supplying ink to said second containing chamber, and a switching cock provided for said ink supply tube to supply or cut off ink flow in said ink supply tube.

11. A liquid discharge recording apparatus according to claim 10, wherein said ink supply tube is made separable from said second containing chamber, and said ink supply tube is provided with an ink injection needle for connection with said second containing chamber, and said second containing chamber is provided with a rubber plug having a hole for said ink injection needle to be inserted.

* * * * *

UNITED STATES PATENT AND TRADEMARK OFFICE

CERTIFICATE OF CORRECTION

PATENT NO. : 6,398,353 B1
DATED : June 4, 2002
INVENTOR(S) : Ken Tsuchii

It is certified that error appears in the above-identified patent and that said Letters Patent is hereby corrected as shown below:

Title page,
Item [57], ABSTRACT,
Line 3, "a" should read -- an --.

Column 1,
Line 58, "filer 60." should read -- filter 60. --.

Column 2,
Line 15, "enter" should read -- enters --;
Line 41, "is" should read -- is a --; and
Line 60, "enter" should read -- enters --.

Column 3,
Line 20, "In" should read -- in --;
Line 57, "a" should read -- an --; and
Line 65, "structure," should read -- structured, --.

Column 8,
Line 21, "are" should read -- is --.

Column 9,
Line 18, "operating ink supply." should read -- when supplying ink. --.

Column 12,
Line 30, "us" should read -- is --; and
Line 49, "Embodiment)" should read -- Embodiments) --.

Signed and Sealed this

Twenty-sixth Day of November, 2002

*Attest:*

*Attesting Officer*

JAMES E. ROGAN
*Director of the United States Patent and Trademark Office*